US011370093B2

(12) United States Patent
Kochie et al.

(10) Patent No.: US 11,370,093 B2
(45) Date of Patent: Jun. 28, 2022

(54) BALL JOINT PRESS TOOL WITH COUPLEABLE ADAPTERS

(71) Applicant: Robert Bosch GmbH, Stuttgart (DE)

(72) Inventors: Robert Kochie, Dodge Center, MN (US); Robert Jensen, Clarks Grove, MN (US)

(73) Assignees: Bosch Automotive Service Solutions Inc., Warren (ML); Robert Bosch GmbH, Stuttgart (DE)

( * ) Notice: Subject to any disclaimer, the term of this patent is extended or adjusted under 35 U.S.C. 154(b) by 78 days.

(21) Appl. No.: 16/851,789

(22) Filed: Apr. 17, 2020

(65) Prior Publication Data

US 2020/0346330 A1 Nov. 5, 2020

Related U.S. Application Data

(60) Provisional application No. 62/840,729, filed on Apr. 30, 2019.

(51) Int. Cl.
*B25B 5/10* (2006.01)
*B25B 27/02* (2006.01)

(52) U.S. Cl.
CPC ..... *B25B 27/02* (2013.01); *B25B 5/101* (2013.01)

(58) Field of Classification Search
CPC .. B25B 1/00; B25B 1/08; B25B 5/067; B25B 5/082; B25B 5/101; B25B 5/125
USPC ..... 29/257; 269/143, 249
See application file for complete search history.

(56) References Cited

U.S. PATENT DOCUMENTS

| | | | | |
|---|---|---|---|---|
| 5,857,252 | A * | 1/1999 | Jansen | B25B 27/062 29/257 |
| 7,669,305 | B1 * | 3/2010 | Lionberg | B25B 27/02 29/257 |
| 7,895,723 | B2 * | 3/2011 | Wridt | B25B 27/062 29/257 |
| 10,744,627 | B2 * | 8/2020 | Andrews | B25B 1/103 |

* cited by examiner

*Primary Examiner* — Monica S Carter
*Assistant Examiner* — Sarah Akyaa Fordjour
(74) *Attorney, Agent, or Firm* — David Kovacek; Maginot, Moore & Beck LLP

(57) ABSTRACT

A ball joint press tool having at least one spring-plunger engageable with at least one adapter to releasably couple the adapter to the tool allowing for single handed placement of the tool regardless of orientation of the tool. The ball joint press tool has at least one adapter-receiving aperture and the spring-plunger has an adapter-engagement head, such as a ball, spring biased to at least partially extend into the adapter-receiving aperture on the tool. An adapter having a connecting projection defining a spring-plunger engaging detent, such as a groove, is insertable into the adapter-receiving aperture wherein the adapter-engagement head of the spring-plunger engages with the spring-plunger engaging detent.

19 Claims, 12 Drawing Sheets

BALL JOINT PRESS TOOL WITH COUPLEABLE ADAPTERS

TECHNICAL FIELD

This disclosure relates to mechanical automotive service tools, and specifically universal ball joint press tools.

BACKGROUND

Ball joints are spherical bearings that typically connect control arms to steering knuckles allowing wheels to pivot relative the suspension of an automobile. They are today almost universally used in the front suspension, having replaced the kingpin/linkpin or kingpin/trunnion arrangement, but can also be found in the rear suspension of some higher-performance vehicles.

Many modern manufactured automobiles use MacPherson strut suspension, which utilizes one ball joint per side located between the lower end of the strut and the control arm. In non-MacPherson strut automobile suspension, there are typically two ball joints per side, one generally referred to as the upper ball joint and the other generally referred to as the lower ball joint. Ball joints may wear out due to fore and aft loads, primarily due to braking, lateral cornering loads, or, depending on the suspension design, vertical loads from the suspension spring. In any event, ball joints may wear out and require service.

In simplest form, a ball joint typically consists of a bearing stud having a ball substantially disposed in a socket defined by a casing; typically these parts are made of steel. One end of the bearing stud, opposite the ball, is usually tapered and threaded into a tapered receiving hole in the steering knuckle. The casing is typically connected to a control arm of the steering system, although the ball joint may be inverted with the casing connected to the knuckle and the bearing stud connected to the control arm. A protective rubber-like boot is sometimes disposed around at least a portion of the ball and socket to prevent dirt from getting into the joint assembly. The rubber-like boot may also be used to help retain lubrication within the socket. The opening of the socket may have an inner-diameter substantially similar in size, yet slightly smaller, than the outer diameter of the ball. This creates a press-fit for the ball to pop into the socket, although other retaining mechanisms may be used. To service the ball joint, it may be desirable to separate the ball from the socket, and in this scenario a ball joint press tool may be utilized to pop the ball back out of the socket.

Current universal ball joint press tools utilize adapters to fit many different sizes and shapes of ball joints. An example of this is the OTC 6559 Ball Joint Master Service Kit. These universal ball joint press tools require the adapters to be stacked requiring one hand to hold at least one of the adapters and another hand to hold the press tool. This then can cause some difficulty when yet another hand is needed to actuate a screw to manually operate the press aspect of the tool. Therefore it would be advantageous to have a universal press tool having removably coupleable (and thusly decoupleable and exchangeable) adaptors that may be used with a single hand while positioning the tool.

SUMMARY

One aspect of this disclosure is directed to a ball joint press tool with releasably coupleable adapters utilizing spring plungers. In this aspect, the tool has a frame which defines an adapter-receiving aperture and a press-assembly aperture. In this aspect, both the adapter-receiving aperture and the press-assembly aperture have centroids, or center points of each opening, and the centroids (a first and second centroid, respectively) define a press axis. Also in this aspect, the frame defines a spring-plunger aperture. The spring-plunger aperture has an intersecting-end which intersects a portion of the adapter-receiving aperture.

In this same aspect, a spring-plunger is disposed in the spring-plunger aperture. The spring-plunger is made up of at least a spring adjacent to an adapter-engagement head. The spring is disposed in the spring-plunger aperture and the adapter-engagement head is at least partially disposed within the spring-plunger aperture and at least partially extendable into the adapter-receiving aperture.

In this aspect, a portion of a press assembly is disposed in and extends through the press-assembly aperture. The press assembly is configured to actuate substantially along the press axis toward and away from the adapter-receiving aperture. The press assembly may be a screw, but other linear actuation mechanisms may be used.

In this aspect, an adapter is utilized that has connecting projection which may be partially disposed within the adapter-receiving aperture. The connecting projection has a spring-plunger engaging detent, or detent. As said, the connecting projection is designed to be at least partially disposable within the adapter-receiving aperture, and when it is, the adapter-engagement head of the spring-plunger can become at least partially engaged with the spring-plunger engaging detent. This engagement helps to couple the adapter, while at the same time allows the adapter to be de-coupled with enough force to overcome a threshold is applied.

With this aspect, there may be multiple spring-plunger apertures, each having an intersecting-end intersecting a portion of the adapter-receiving aperture. Thusly, there may be multiple spring plungers in the spring-plunger apertures, and they may be regularly spaced around a perimeter-wall of the adapter-receiving aperture. This regular spacing can provide more stability of the adapter before a press occurs. The frame may also have an adapter shelf disposed adjacent to the adapter-receiving aperture. This adapter shelf may be orthogonal to the press axis, and the adapter may 'sit' on the adapter shelf when the ball joint press tool is used to press a ball joint Additionally in this aspect, there may also be a second adapter-receiving aperture as part of the press assembly. The second adapter-receiving aperture may be defined by an adapter-receiving segment of the press assembly that is disposed substantially along the press axis between the first adapter-receiving aperture and the press-assembly aperture. When there is a second adapter-receiving aperture on the press assembly, it faces the first adapter-receiving aperture.

Accordingly, if there is a second adapter-receiving aperture, then there may also be a second spring-plunger as part of the adapter-receiving segment of similar configurations to that described above. And similarly to that described above, there may be a number of second spring-plunger apertures, each having a second intersecting-end of each of the second spring-plunger apertures intersecting a portion of the second adapter-receiving aperture.

Another aspect of this disclosure is directed to a ball joint press tool having a C-shaped frame with a first and second end. In this aspect, the first end defines a first adapter-receiving aperture, and the second end defines a press-assembly aperture. The center points of these two apertures define a press axis for the tool. The C-shaped frame further defines a first spring-plunger aperture having a first intersecting-end intersecting a portion of the first adapter-receiving aperture. In this aspect, a first spring-plunger is disposed in the first spring-plunger aperture, the first spring-plunger having a first spring and a first ball. The first ball is spring biased by the first spring to extend at least partially into the first adapter-receiving aperture.

In this aspect, a press assembly is disposed in and extends through the press-assembly aperture having an adapter-receiving segment between the first adapter-receiving aperture and the press-assembly aperture. The adapter-receiving segment defines a second adapter-receiving aperture, an intersecting second spring-plunger aperture, and a second spring-plunger disposed in the second spring-plunger aperture, similar to the firsts. Accordingly, a second ball is spring biased to extend into the second adapter-receiving aperture.

In this aspect, there are also two adapters; a first adapter and a second adapter. Each adapter has a respective first and second connecting projection defining first and second spring-plunger engaging detents. The first and second connecting projections are insertable within the first and second adapter-receiving apertures, and when this occurs, the first and second balls engage with the adapters to releasably couple them to the ball joint press tool during use.

The above aspects of this disclosure and other aspects will be explained in greater detail below with reference to the attached drawings.

BRIEF DESCRIPTION OF THE DRAWINGS

FIG. 15 is a second perspective side view of an embodiment of a coupleable adapter ball joint press tool with a non-coupled adapter.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
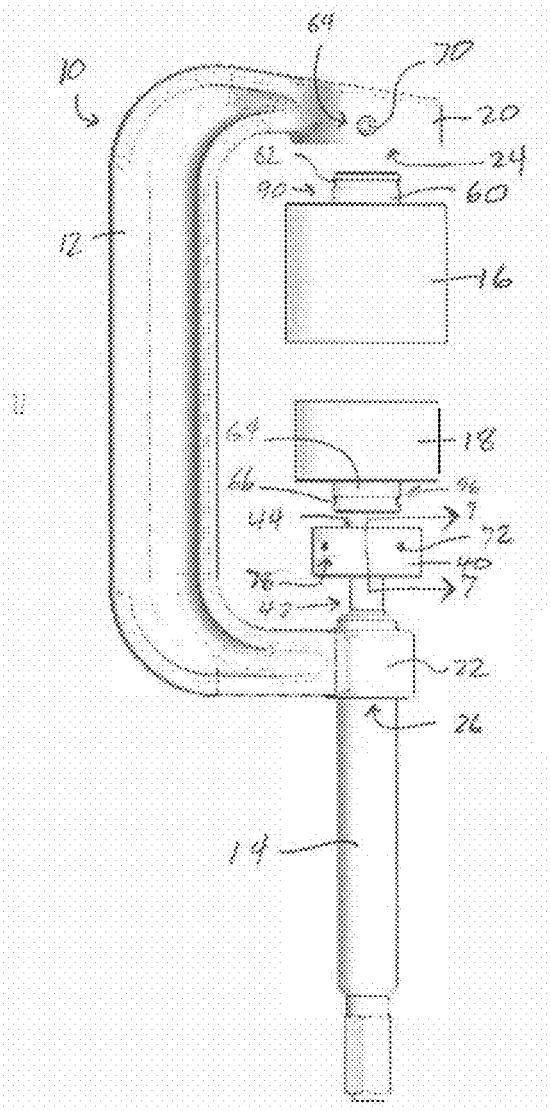
FIG. 1 is a side view of a coupleable adapter ball joint press tool with the adapters de-coupled.
Figure 2:
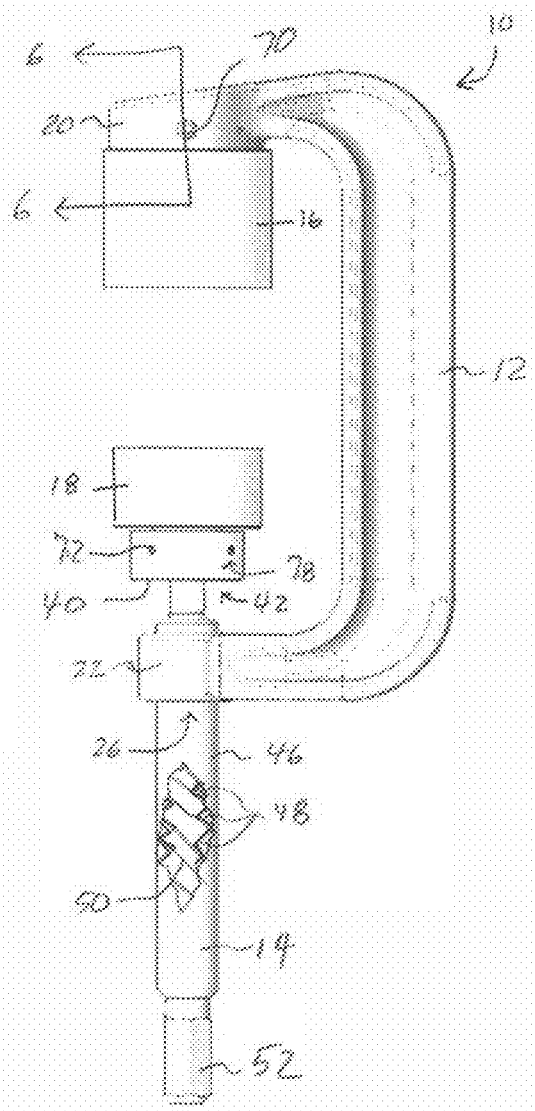
FIG. 2 is a side view of a coupleable adapter ball joint press tool with the adapters coupled.
Figure 3:
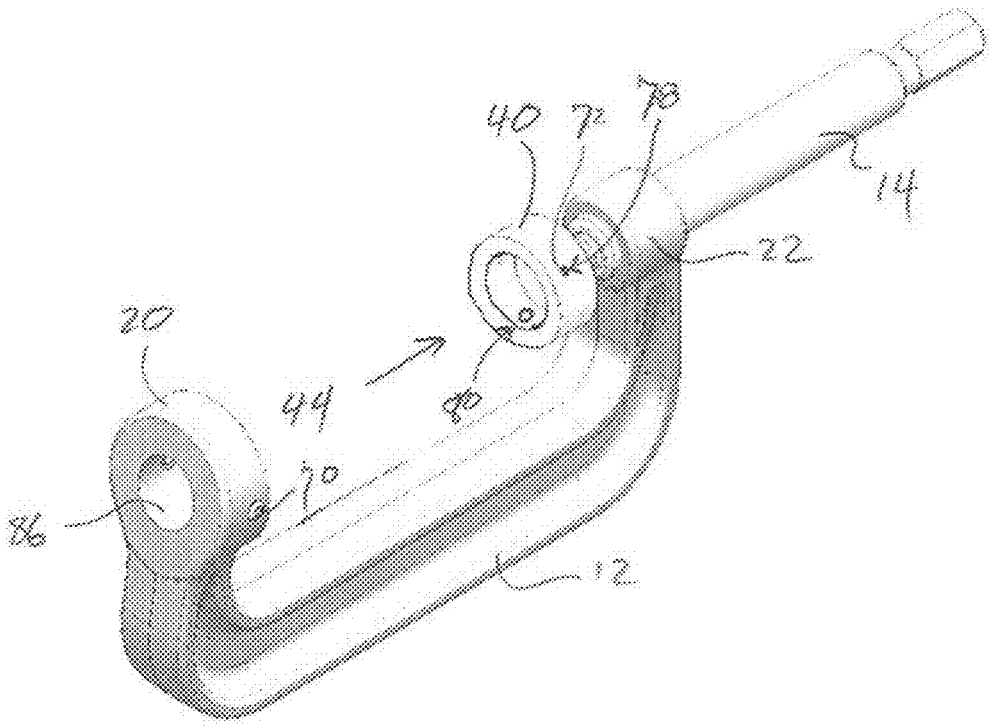
FIG. 3 is a perspective upper view of a coupleable adapter ball joint press tool without adapters.
Figure 4:
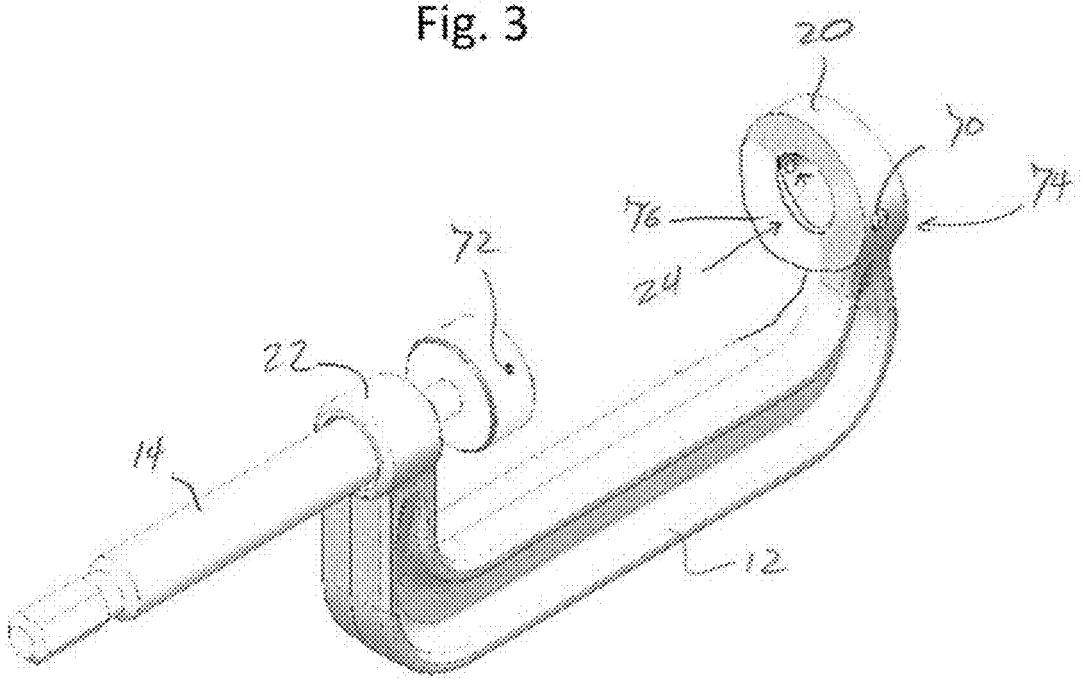
FIG. 4 is a perspective lower view of a coupleable adapter ball joint press tool without adapters.

FIGS. 1 and 2 show an example of a ball joint press tool 10 having a frame 12, a press assembly 14, and a first and second adapter 16, 18. FIGS. 3 and 4 show an example of the ball joint press tool 10 without adapters 16, 18 from upper and lower perspective views. Frame 12 is shown as a C-shaped frame 12, but other configurations may be used. Regardless of shape, frame 12 has a first end 20 and a second end 22, in which the first end 20 defines an adapter-receiving aperture 24 (best seen in FIGS. 4 & 5) and the second end 22 defines a press-assembly aperture 26 (best seen in FIG. 5).

Figure 5:
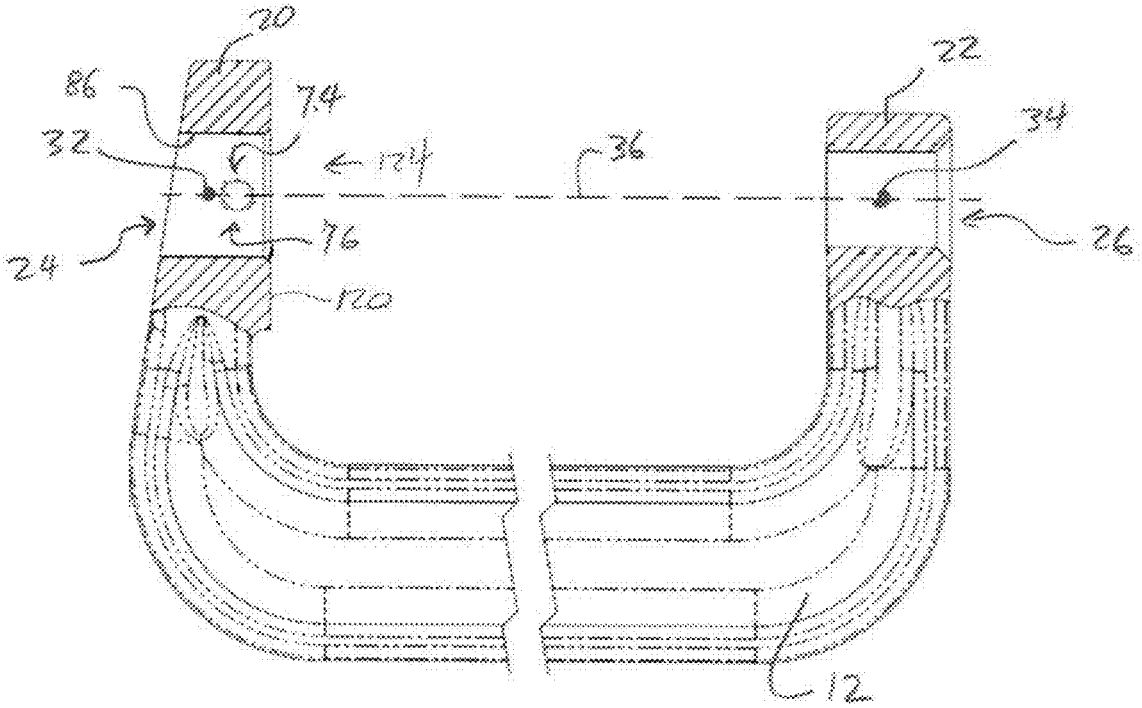
FIG. 5 is a diagrammatic illustration of a frame with first and second ends sectioned.

FIG. 5 is a diagrammatic illustration of frame 12 with the first and second ends 20, 22 sectioned. In this figure, it can be seen that the adapter-receiving aperture 24 has a first centroid 32, or center point, the press-assembly aperture 26 has a second centroid 34, and the two centroids 32, 34 define a press axis 36. Press-assembly aperture 26 is a thru-hole extending fully through the frame 12. Adapter-receiving aperture 24 is shown as a thru-hole extending fully through the frame 12, but a blind-hole that does not pass through the frame 12 may also be used. The frame 12 is shown as a C-shape frame 12, however, any design that allows for a ball joint, or similar device needing to be pressed, to be situated between the adapter-receiving aperture 24 and the press-assembly aperture 26 such that a press force may be applied by the tool substantially in-line with the press axis is acceptable.

Returning back to FIGS. 1-4, the press-assembly aperture 26 is a thru-hole, and a portion of the press assembly 14 is disposed within and extends through the press-assembly aperture 26. The press assembly 14, as shown here, has an adapter-receiving segment 40 on a proximal end 42 of the press assembly 14. The adapter-receiving segment 40 defines a second adapter-receiving aperture 44 (best seen in FIG. 3). Although in some embodiments the press-assembly aperture does not have an adapter-receiving segment on the proximal end 42. Rather, in some embodiments the adapter 18 is an integral part of the adapter-receiving segment (such that there is no adapter-receiving segment 40 defining a second adapter-receiving aperture 44 providing for a releasably coupling opportunity as described in this application). In other embodiments, the proximal end 42 has a flat plate, a shaft point, a cutting tool such as a drill bit or a self-taping screw head, or any number of other press head components or engaging surfaces of varying sizes and dimensions as may be desired (not shown). The adapter-receiving segment 40, when used, is located between the first adaptor-receiving aperture 24 and the press-assembly aperture 26.

The press assembly 14 is configured to actuate the adapter-receiving segment 40 toward and away from the adapter-receiving aperture 24 on the first end 20 of the frame 12. The frame 12 shall be configured to support actuation of the adapter-receiving segment 40 toward the adapter-receiving aperture 24 substantially along the press axis 36 (see FIG. 5) during set up and in use under load. Substantially, as used with the direction of the press axis, means within +/−15 degrees off the press axis line. In the embodiment shown, the press assembly 14 is a screw-type press assembly, although other configurations may be used, which has an outer tube 46 with inner-diameter teeth 48, and a threaded shaft 50 which may be rotated at a distal end 52 to advance and retard the shaft 50 within the tube 46 actuating the adapter-receiving segment toward and away from the adapter-receiving aperture 24.

In this embodiment, the outer tube 46 is secured within the press-assembly aperture 26, which may be accomplished by press fit, a weld bead, adhesive, a securing screw (not shown), or other known fixing methods. In an alternate embodiment, the second end of the frame defines threads along a portion of a wall of the press-assembly aperture 26, and the threaded shaft 50 engages directly with the frame 12. The adapter-receiving segment 40 may be a unitary part of the threaded shaft 50 or may be separate from the threaded shaft 50 and permanently or releasably connectable thereto. The distal end 52 may be a hexagon design configured to accept a wrench.

FIG. 1 shows the adapters 16, 18 decoupled from the frame 12 and the press assembly 14. FIG. 2 shows the adapters 16, 18 coupled to the frame 12 and the press assembly 14, respectively. First adapter 16 has a first connecting projection 60 which may be at least partially disposed within the first adapter-receiving aperture 24 (see also FIG. 6). The first connection projection 60 defines a first spring-pinger detent 62. The second adapter 18 has a second connecting projection 64 which may be at least partially disposed within the second adapter-receiving aperture 44. The second connection projection 64 defines a second spring-plunger detent 66. Detents 62, 66 may be grooves extending around an outer-perimeter of the connecting projections 60, 64. First and second connecting projections 60, 64 may be similar in shape and design for interchangeability between first and second adapter-receiving apertures 24, 44, or they may be purposely different for special tools requiring a specific orientation only allowing for specific adapters to be utilized in a specific direction.

The releasable coupling of the adapters 16, 18 is provided by first and second spring-plungers 70, 72 interacting with the adapters 16, 18, respectively. Frame 12 defines a first spring-plunger aperture 74 having a first intersecting-end 76 intersecting a portion of the first adapter-receiving aperture 24 (see also FIGS. 5 & 6). In other words, the first intersecting-end 76 of the first spring-plunger aperture 74 is in fluid communication with the first adapter receiving aperture 24.

Figure 7:
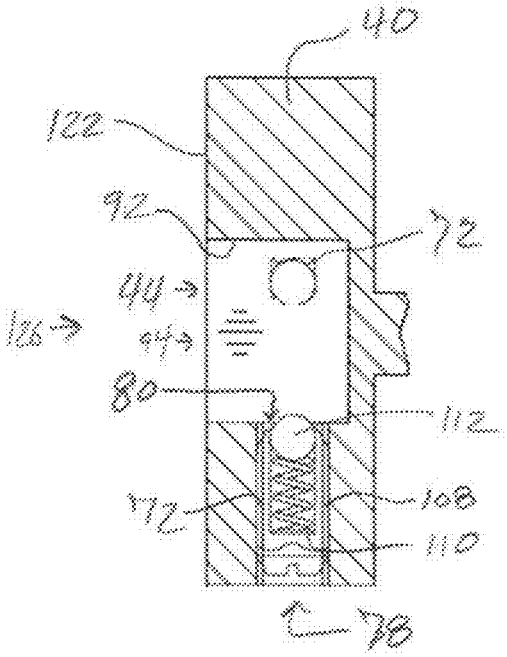
FIG. 7 is a diagrammatic cross-sectional illustration of an adapter-receiving aperture by without an adapter.
Figure 8:
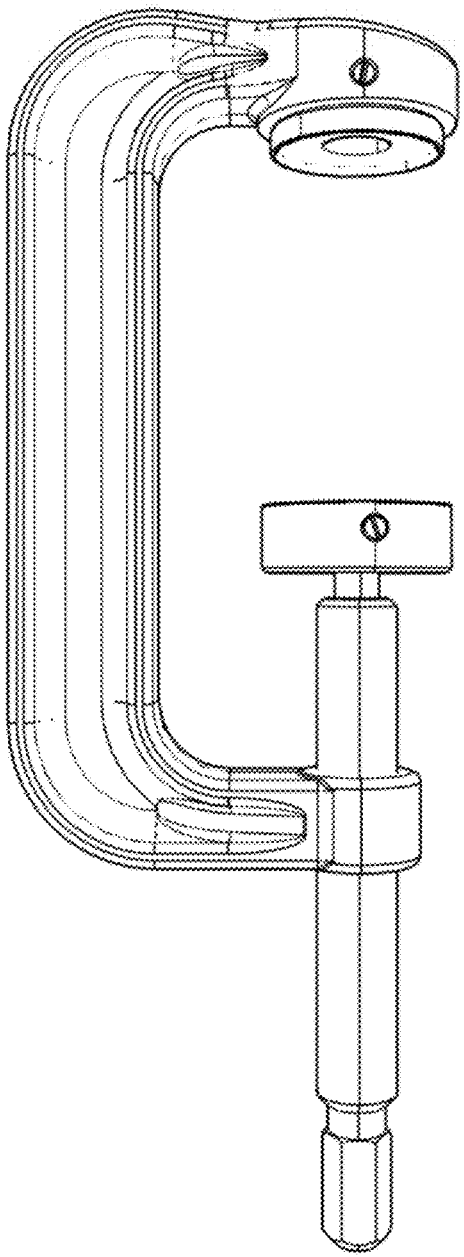
FIG. 8 is a first side view of an embodiment of a coupleable adapter ball joint press tool.
Figure 9:
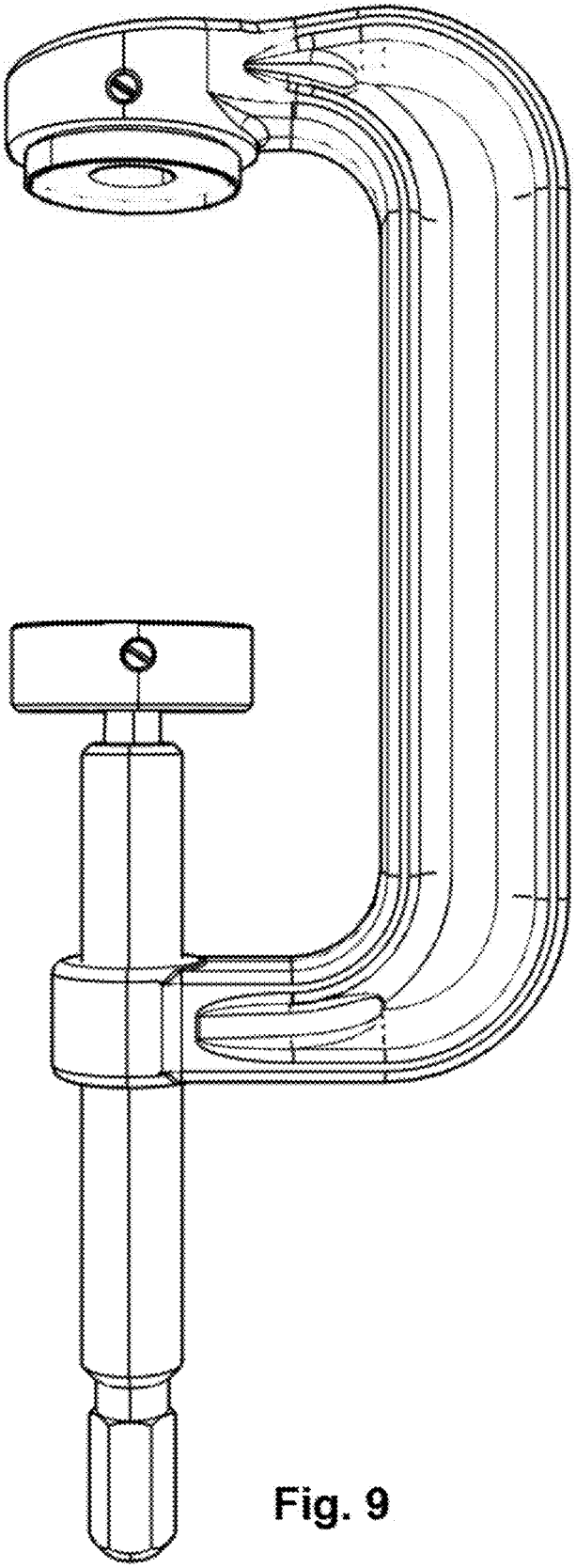
FIG. 9 is a second side view of the embodiment of a coupleable adapter ball joint press tool from FIG. 8.
Figure 10:
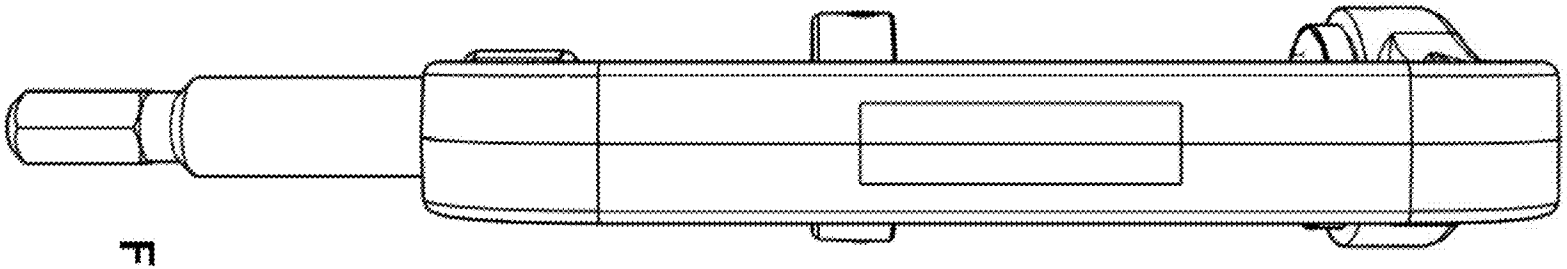
FIG. 10 is a rear view of the embodiment of a coupleable adapter ball joint press tool from FIG. 8.
Figure 11:
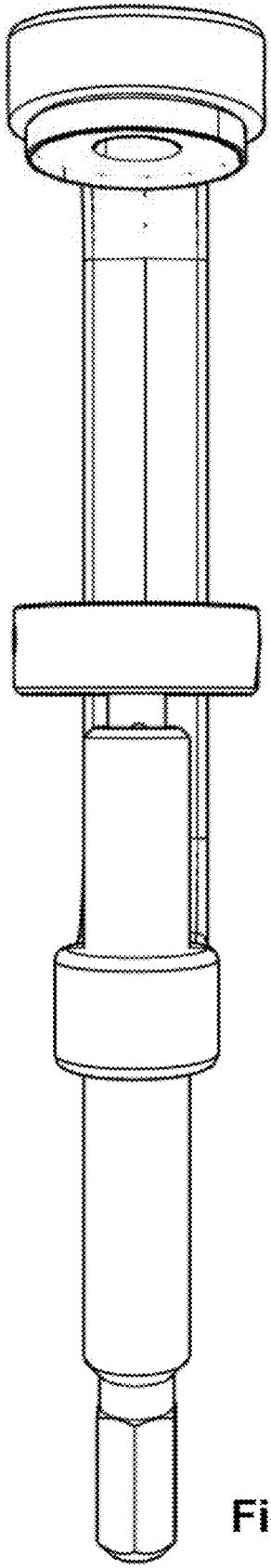
FIG. 11 is a front view of the embodiment of a coupleable adapter ball joint press tool from FIG. 8.
Figure 12:
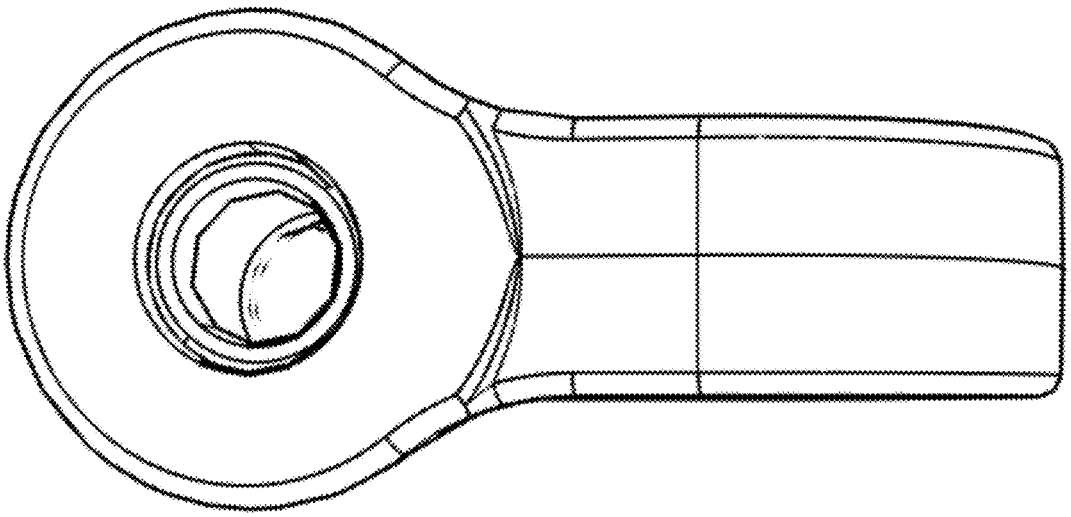
FIG. 12 is a top view of the embodiment of a coupleable adapter ball joint press tool from FIG. 8.
Figure 13:
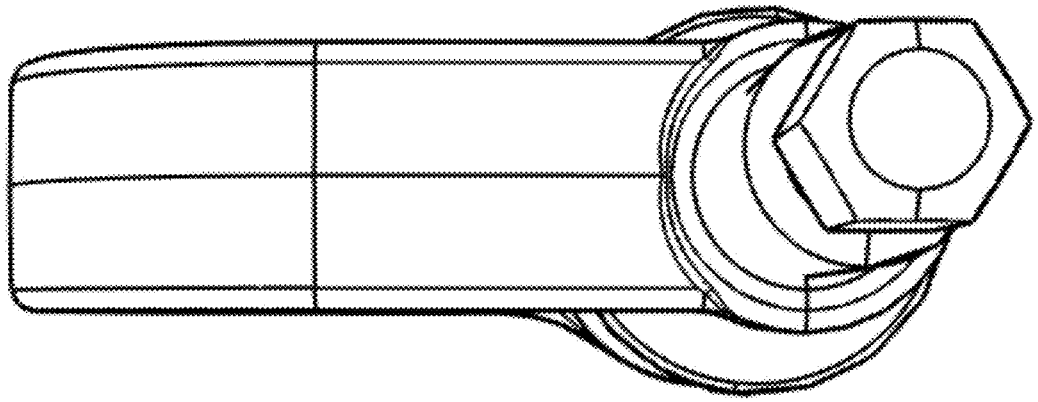
FIG. 13 is a bottom view of an embodiment of a coupleable adapter ball joint press tool from FIG. 8.

The adapter-receiving segment 40 of the press assembly 14 defines a second spring-plunger aperture 78 having a second intersecting-end 80 intersecting a portion of the second adapter-receiving aperture 44 (see FIGS. 3 & 7). In other words, the second intersecting-end 80 of the second spring-plunger aperture 78 is in fluid communication with the second adapter-receiving aperture 44.

Figure 6:
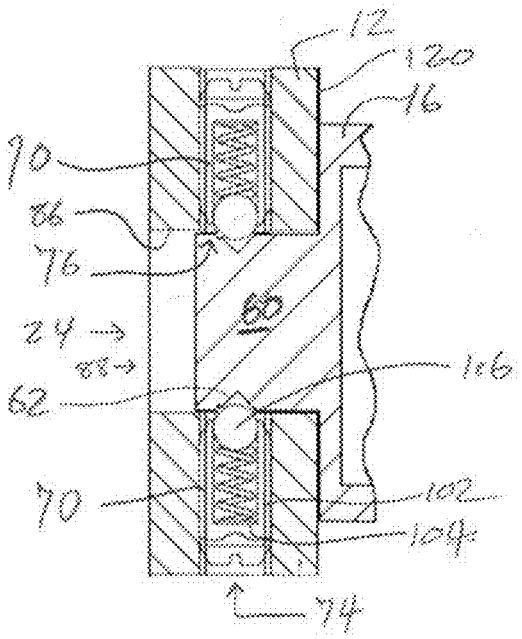
FIG. 6 is a diagrammatic cross-sectional illustration of an adapter being held in an adapter-receiving aperture by a spring-plunger.

Referring now to FIG. 6, the adapter-receiving aperture 24 is shown with a perimeter-wall 86 defined by the frame 12. In this example, the perimeter-wall 86 is substantially circular in shape, although any shape may be used. Substantially, as used with circularity, means the diameter of the hole is +/−10 mm traveling down the depth of the hole and radius of the hole is +/−10 mm along any radian at any point traveling down the depth of the hole. The perimeter-wall 86 extends substantially parallel to the press axis 36. The perimeter-wall 86 defines an inner-perimeter dimensional shape 88. Similarly, the first connecting projection 60 has an outer-perimeter dimensional shape 90 which is similar, yet smaller in dimensions, than the inner-perimeter dimensional shape 88, thus allowing for disposal of the connecting projection 60 of the adapter 16 within the adapter-receiving aperture 24. This tolerance control allows for the adapters 16, 18 to rotate in the adapter-receiving apertures 24, 44, so that the adapters may be easily inserted at any rotational difference. However, in the case where the rotational angle of an adapter is desired to be fixed, the o inner-perimeter dimensional shape of the adapter-receiving apertures may symmetrical or A-symmetrical and any desired geometric shape to achieve the desired orientation.

Referring to now to FIG. 7, the second adapter-receiving aperture 44 is shown with a second perimeter-wall 92 defined by the adapter-receiving segment 40. This perimeter-wall 92 is also substantially circular in shape, although, as above, any shape may be used. The second perimeter-wall 92 is configured to also extend substantially parallel to the press axis 36, although stacking tolerances may add up to be outside of the tolerances listed above. The second perimeter-wall 92 defines a second inner-perimeter dimensional shape 94. Similarly, the second connecting projection 64 has a second outer-perimeter dimensional shape 96 that is configured to be a similar shape, yet smaller in dimensions, than the inner-perimeter dimensional shape 94, thus allowing for disposal of the second connecting projection 64 of the second adapter 18 within the second adapter-receiving aperture 44 (see FIGS. 1 & 2). The second inner-perimeter dimensional shape 94 may be similar to the first inner-perimeter dimensional shape 88, and the second outer-perimeter dimensional shape 96 may be similar to the first outer-perimeter dimensional shape 90 to provide for interchangeability of adapters 16, 18 in any rotational orientation, and on either end of the tool.

Referring to both FIGS. 6 and 7, first and second spring-plungers 70, 72 are shown disposed in first and second spring-plunger apertures 74, 78. The first spring-plunger 70 has a first housing 102, which may be threaded, a first spring 104 and a first adapter-engagement head 106. The spring-plunger apertures 74, 78 may be threaded to accept threaded housing spring-plungers 70, 72, although other fixing methods may be employed. The adapter-engagement head 106 may be a ball 106, a pin-head 106, or any other known spring-plunger engagement mechanism. The first spring 104 is disposed within the first spring-plunger aperture 74. The first adapter-engagement head 106 is at least partially disposed within the first spring-plunger aperture 74 and spring biased by the first spring 104 to extend at least partially into the first adapter-receiving aperture 24.

The second spring-plunger 72 has a second housing 108, which may be threaded, a second spring 110, and a second adapter-engagement head 112. The second adapter-engagement head 112 may be a ball 112, a pin-head 112, or any other known spring-plunger engagement mechanism. The second spring 110 is disposed within the second spring-plunger aperture 78. The second adapter-engagement head 112 is at least partially disposed within the second spring-plunger aperture 78 and spring biased by the second spring 110 to extend at least partially into the second adapter-receiving aperture 44.

Referring now to FIG. 6, it can be seen that the first spring-plunger 70 is at least partially engageable with the first spring-plunger engaging detent 62. This engagement, along with the design of the first connecting projection 60 and the first adapter-receiving aperture, allows for the releasable coupling of the first adapter 16 to the ball joint press tool 10 during use. In this figure, the adapter-engagement head 106 is a ball 106, the spring-plunger engaging detent 62 is a groove 62, and the ball 106 is spring biased at least partially into the groove 62. Thus a force is necessary to slide the ball 106 out of the groove 62 while pushing back against the biasing of the spring 104, and this is the releasably coupling of the adapter 16 within the adapter-receiving aperture 24.

The first spring-plunger aperture 74 may be a number of first spring plunger apertures 74, each having a first intersecting-end 76 intersecting the first inner-diameter perimeter wall 86. Accordingly, a number of first spring-plungers 70 may be partially disposed in the number of first spring plunger apertures 74. The number of first spring-plunger apertures 74 may be regularly spaced around the inner-diameter perimeter wall 86 of the first adapter-receiving aperture 24. In FIG. 6, there are two first spring plunger apertures 74, located 180 degrees opposite each other. First spring plunger apertures 74 may also be orthogonal to the perimeter-wall 86, and thus the press axis 36 (see FIG. 5).

In FIG. 7, the second spring-plunger aperture 78 may be a number of second spring plunger apertures 78, each having a second intersecting-end 80 intersecting the second inner-diameter perimeter wall 92 of the second adapter-receiving aperture 44. Accordingly, a number of second spring-plungers 72 may be partially disposed in the number of second spring plunger apertures 78. The number of second spring-plunger apertures 78 may be regularly spaced around the second inner-diameter perimeter wall 92. Second spring plunger apertures 78 may be orthogonal to the perimeter-wall 92, and thus the press axis 36. Here there are three second spring plunger apertures 78 shown, one identified as a center, and the other two located 140 degrees opposite the center, and thus leaving 80 degrees between the two. Regular spacing may be equal spacing, in the case of two having 180 degrees separation, or three having 120 degree separation (i.e., forming an equilateral triangle), or it may be non-equal spacing, such as described above (i.e., forming an isosceles triangle).

Although adapter 18 is not shown at least partially disposed in the second adapter-receiving aperture 44 in FIG. 7, the mechanism is similar to that shown in FIG. 6, in that the second adapter-engagement head 112 is spring biased at least partially into the spring-plunger detent 66 (see FIG. 1). Additionally, first and second adapter-engagement heads 106, 112 may be the same shape and configuration, or different as the design of the tool dictates. First and second springs 104, 110 may have differing spring forces from each other, and spring forces amongst the springs used in the same adapter-receiving aperture may even differ (like in the case of non-equal regular spacing). For example, in the case where more spring-plungers 70, 72 are used around the adapter-receiving apertures 24, 44, a lower the spring force may be used.

To aid in the stability of an adapter 16, 18, an adapter shelf 120, 122 may be utilized. The adapter shelf 120 is defined by the first end 20 of the frame 12 and is adjacent to the first adapter-receiving aperture 24 on a first adapter entry side 124 of the first adapter-receiving aperture 24. The adapter shelf 120 is defined by the adapter-receiving segment 40 of the press assembly 14 and is adjacent to the second adapter-receiving aperture 44 on a second adapter entry side 126 of the second adapter-receiving aperture 44. Adapter shelves 120, 122 are substantially orthogonal to the press axis 36 (see FIG. 5).

Spring-plungers 70, 72 engaging in spring-plunger detents 62, 66 are an advantage over previous designs allowing for adapters 16, 18 to be coupled to the tool 10 so that holding the adapters in place while position the tool is unnecessary. Previous tools all have components that at some level can slide apart or fall out depending on the orientation of the tool. Additionally, providing female adapter-receiving apertures 24, 44 (along with adapter shelves 120, 122) and male connecting projections 60, 64 provides a more robust arrangement than previous designs. Furthermore, having a female receiving first adapter-receiving aperture 24 reduces the need for additional componentry to be fixed into the frame 12 to provide a male connecting surface. Combining this concept with a threaded press-assembly aperture 26 reduces componentry even further. However, having an outer tube 46 design can keep the threads cleaner in a very dirty and grimy environment.

Figure 14:
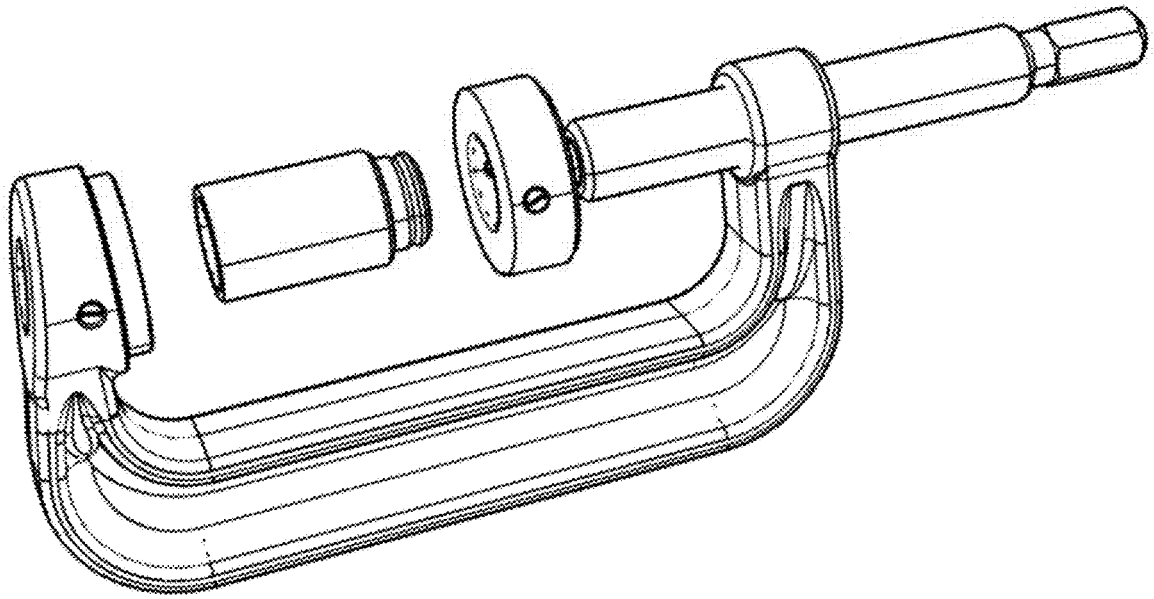
FIGS. 14 and 15 are opposing perspective side views of an embodiment of a coupleable adapter ball joint press tool with a non-coupled adapter in-line with engagement.
Figure 15:
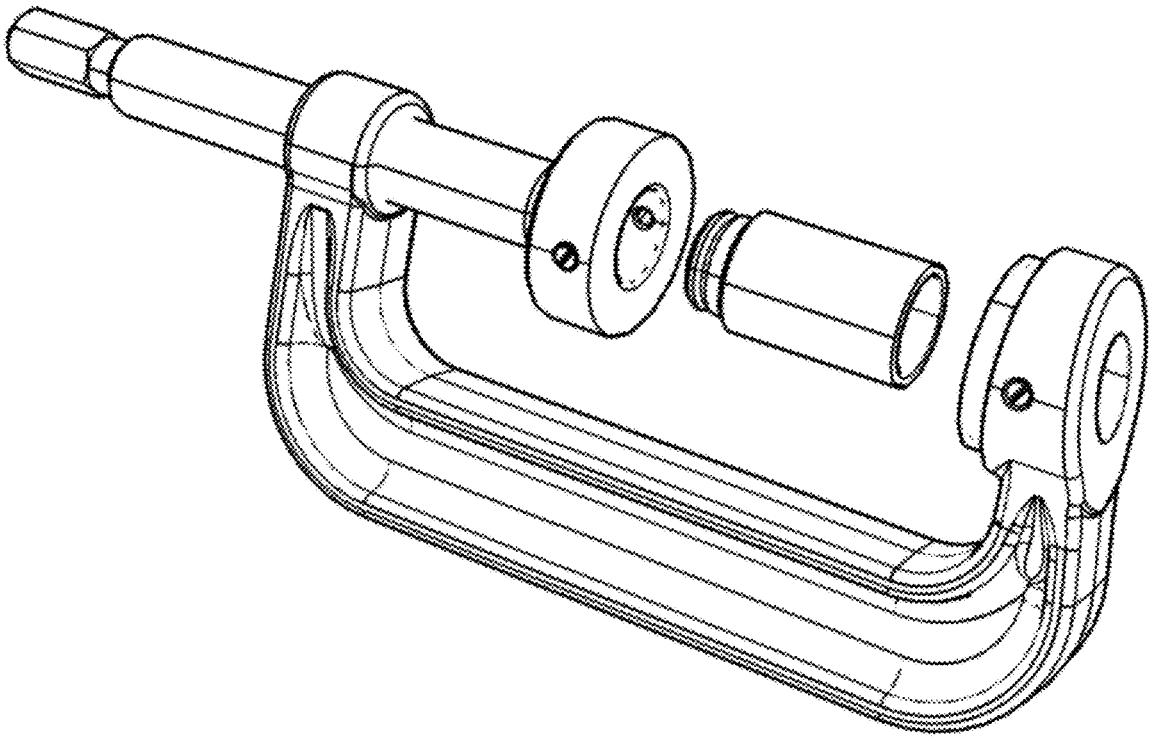
Figure 16:
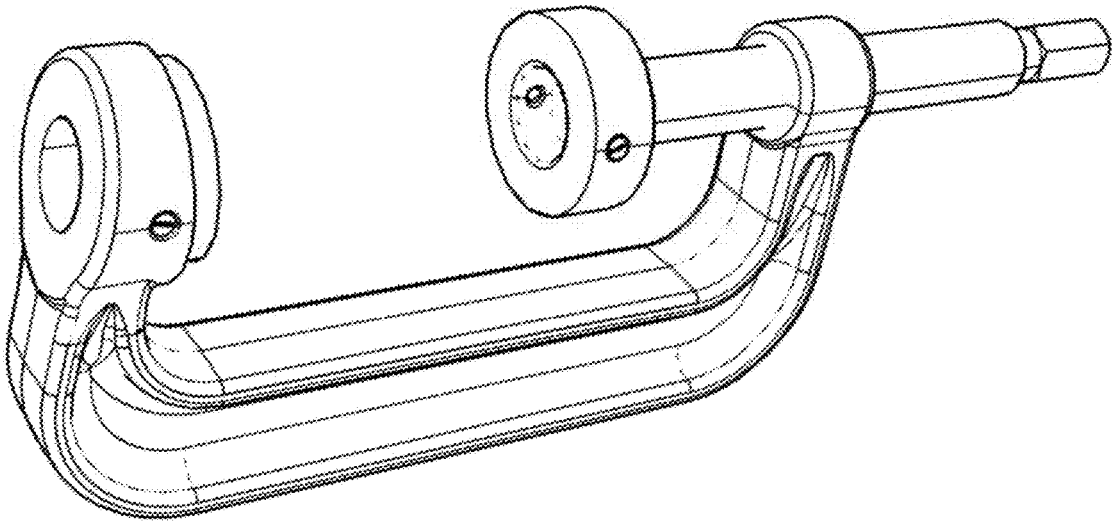
FIG. 16 is a first perspective side view of an embodiment of a coupleable adapter ball joint press tool without an adapter.
Figure 17:
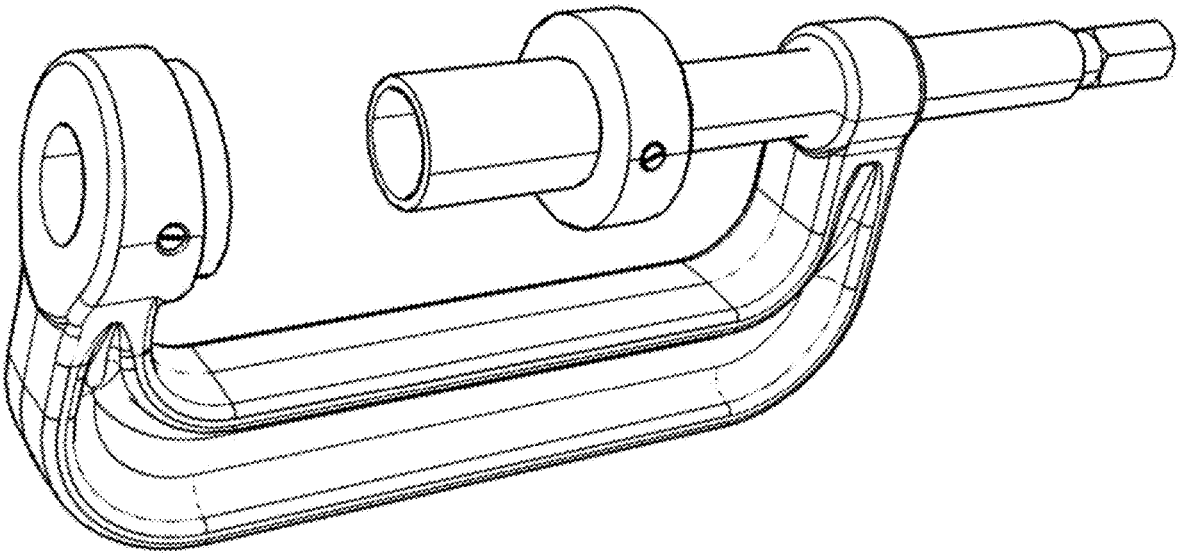
FIG. 17 is the first perspective side view of FIG. 16 with a coupled adapter.
Figure 18:
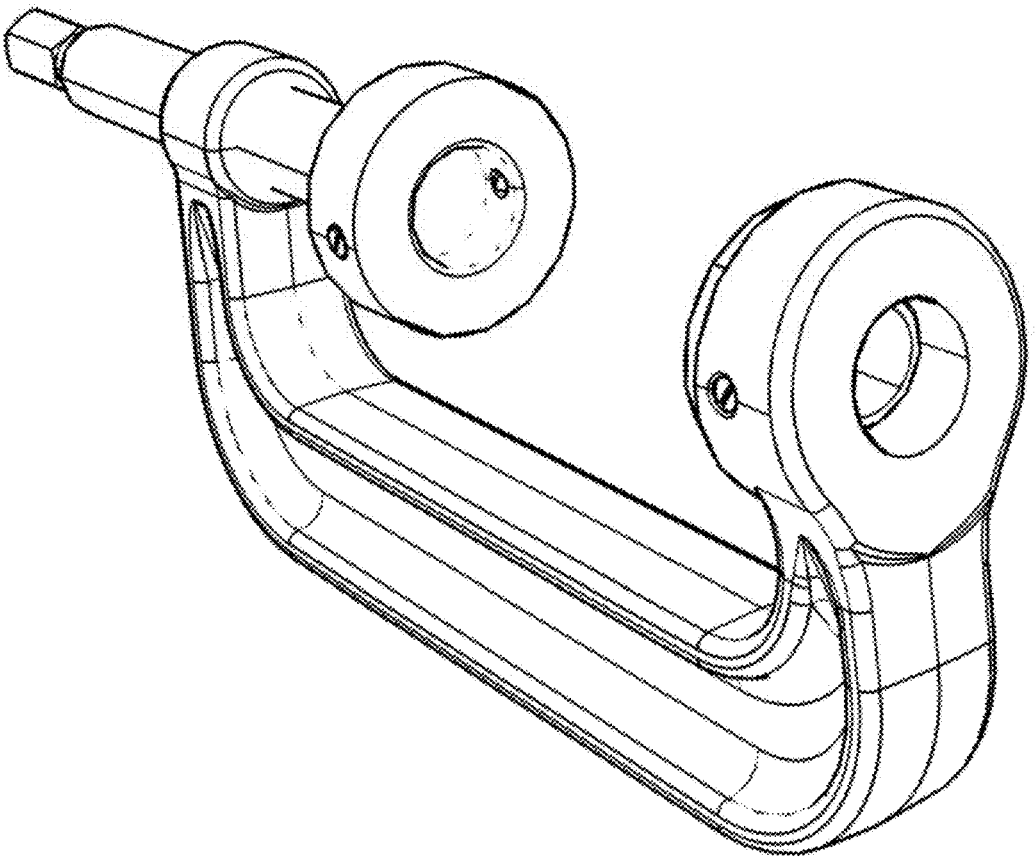
FIG. 18 is a second perspective side view of an embodiment of a coupleable adapter ball joint press tool without an adapter.
Figure 19:
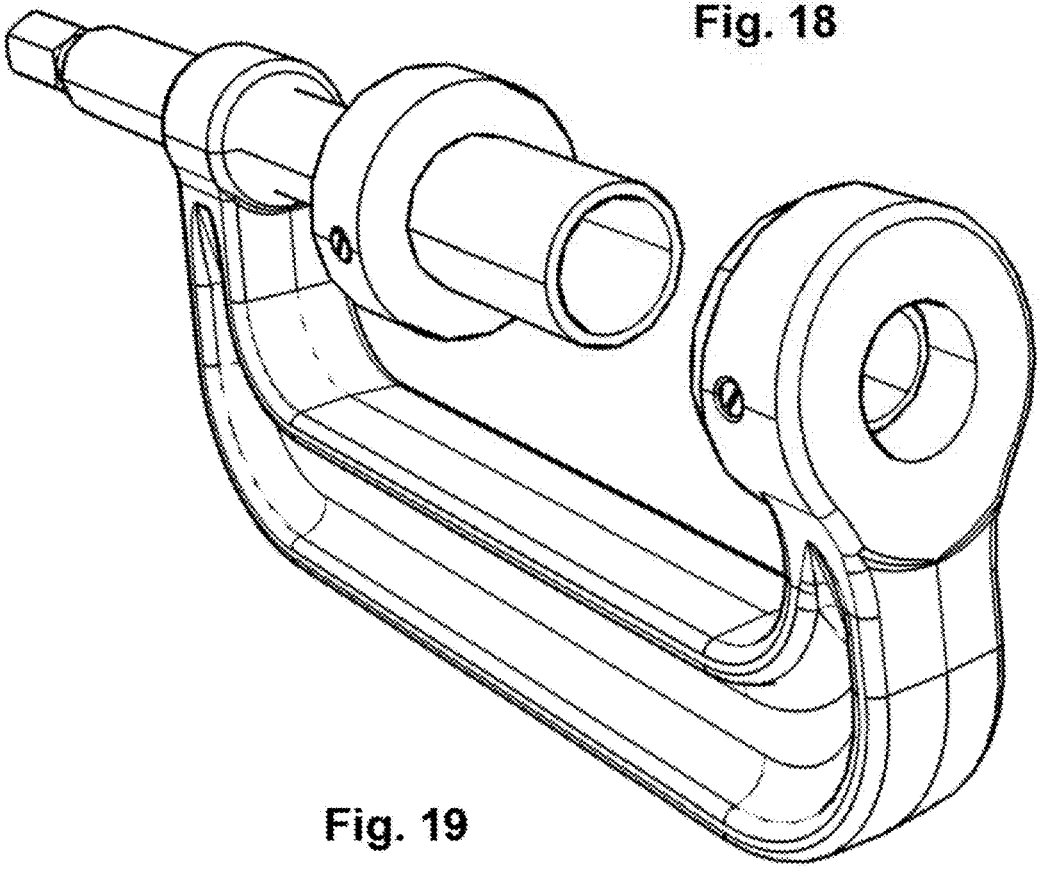
FIG. 19 is the first perspective side view of FIG. 18 with a coupled adapter.

FIGS. 8-13 are varying views of an embodiment of a coupleable adapter ball joint press tool from each side. FIGS. 14 and 15 are opposing perspective side views of another embodiment of a coupleable adapter ball joint press tool, both with a non-coupled adapter in-line for engagement. FIGS. 16 and 17 are first perspective side views of yet another embodiment of a coupleable adapter ball joint press tool, one without an adapter and the other with a coupled adapter, respectively. FIGS. 18 and 19 are second perspective side views of even yet another embodiment of a coupleable adapter ball joint press tool, one without an adapter and the other with a coupled adapter, respectively.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A ball joint press tool, comprising:

a frame defining an adapter-receiving aperture having a first centroid and a press-assembly aperture having a second centroid, wherein the first and second centroids define a press axis, and the frame defining a spring-plunger aperture having an intersecting-end of the spring-plunger aperture intersecting a portion of the adapter-receiving aperture;

a spring-plunger at least partially disposed in the spring-plunger aperture, the spring-plunger having an adapter-engagement head at least partially disposed within the spring-plunger aperture and at least partially extendable into the adapter-receiving aperture;

a press assembly disposed in and extending through the press-assembly aperture configured to actuate along the press axis toward and away from the adapter-receiving aperture;

an adapter having a connecting projection defining a spring-plunger engaging detent, the connecting projection at least partially disposable within the adapter-receiving aperture wherein the adapter-engagement head of the spring-plunger is engageable with the spring-plunger engaging detent; and wherein the spring-plunger aperture comprises a number of spring-plunger apertures, each having an intersecting-end intersecting a portion of the adapter-receiving aperture.

2. The tool of claim 1, in which the spring-plunger aperture is substantially orthogonal to the press axis.

3. The tool of claim 1, wherein the adapter-receiving aperture has a perimeter-wall defined by the flame, and the intersecting-ends of the number of spring-plungers apertures are regularly spaced around the perimeter-wall.

4. The tool of claim 3, wherein the perimeter-wall extends substantially parallel to the press axis.

5. The tool of claim 1, wherein the adapter-receiving aperture has a perimeter-wall defined by the frame providing an inner-perimeter dimensional shape and the connecting projection of the adapter has an outer-perimeter dimensional shape that is similar, yet smaller in dimensions, than the inner-perimeter dimensional shape.

6. The tool of claim 5, wherein the spring-plunger engaging detent is a groove extending around the outer-perimeter of the connecting projection.

7. The tool of claim 5, wherein the perimeter-wall is substantially circular.

8. The tool of claim 1, wherein the adapter-engagement head is a ball.

9. The tool of claim 1, wherein the press-assembly is a screw-type press-assembly.

10. The tool of claim 1, wherein the adapter-receiving aperture is a thru-hole extending fully through a portion of the frame.

11. The tool of claim 1, wherein the adapter-receiving aperture defined by the frame is a first adapter-receiving aperture, and the press assembly further comprises an adapter-receiving segment defining a second adapter receiving aperture.

12. The tool of claim 11, wherein the adapter-receiving segment is disposed substantially along the press axis between the first adapter-receiving aperture and the press-assembly aperture.

13. The tool of claim 11, wherein the adapter-receiving segment of the press assembly defines a second spring-plunger aperture, and the press assembly further comprises a second spring-plunger at least partially disposed in the second spring-plunger aperture, the second spring-plunger having a second adapter-engagement head at least partially disposed within the second spring-plunger aperture and at least partially extendable into the second adapter-receiving aperture.

14. The tool of claim 13, wherein the second spring-plunger aperture is a number of second spring-plunger apertures, each having a second intersecting-end intersecting a portion of the second adapter-receiving aperture.

15. The tool of claim 14, wherein the second adapter-receiving aperture has a second perimeter-wall defined by the adapter-receiving segment, and the second intersecting-ends of the number of second spring-plunger apertures are equally spaced around the second perimeter-wall.

16. The tool of claim 11, wherein the second adapter-receiving aperture is a blind-hole that does not extend fully though the adapter-receiving segment.

17. The tool of claim 1, wherein the frame further defines an adapter shelf disposed adjacent to the adapter-receiving aperture, the adapter shelf being substantially orthogonal to the press axis, and the adapter having a frame-landing lip extending orthogonally outwardly from the connecting projection, the adapter shelf of the frame configured to at least partially contact and support the frame-landing lip of the adapter when the ball joint press tool is being used to press a ball joint.

18. A ball joint press tool, comprising:

a C-shaped frame having a first end and a second end, the first end defining a first adapter-receiving aperture having a first center point and the second end defining a press-assembly aperture having a second center point, the first and second center points of the apertures defining a press axis, and the C-shaped frame further defining a first spring-plunger aperture having a first intersecting-end intersecting a portion of the first adapter-receiving aperture;

a first spring-plunger disposed in the first spring-plunger aperture, the first spring-plunger having a first spring disposed within the first spring-plunger aperture and a first ball at least partially disposed within the first spring-plunger aperture and spring biased by the first spring to extend at least partially into the first adapter-receiving aperture;

a press assembly disposed in and extending through the press-assembly aperture having an adapter-receiving segment disposed between the first adapter-receiving aperture and the press-assembly aperture, the adapter-receiving segment defining a second adapter-receiving aperture and a second spring-plunger aperture having a second intersecting-end intersecting a portion of the second adapter-receiving aperture, and the adapter-receiving segment comprising a second spring-plunger disposed in the second spring-plunger aperture, the second spring-plunger having a second spring and a second ball, wherein the second spring is disposed within the second spring-plunger aperture, and the second ball at least partially disposed within the second spring-plunger aperture and spring biased by the second spring to extend at least partially into the second adapter-receiving aperture;

a first adapter and a second adapter, each having a respective a first and second connecting projection defining first and second spring-plunger engaging detents, the first and second connecting projections at least partially disposable within the first and second adapter-receiving apertures, wherein the first and second balls of the first and second spring-plungers are at least partially engageable with the first and second spring-plunger engaging detents to releasably couple the first and second adaptors to the ball joint press tool during use;

wherein the first and second adapter-receiving apertures are substantially circular along the press axis and have first and second inner-diameter perimeter-walls;

wherein the first spring-plunger aperture is a number of first spring-plunger apertures each having a first intersecting-end intersecting the first inner-diameter perimeter-wall regularly spaced there around;

wherein the second spring-plunger aperture is a number of second spring-plunger apertures each having a second intersecting-end intersecting the second inner-diameter perimeter-wall regularly spaced there around;

wherein the first and second connecting projections have substantially circular first and second outer-perimeter walls that are similar, yet smaller in diameter, than the respective first and second inner-diameter perimeter walls;

wherein the first and second spring-plunger engaging detents of the first and second connecting projections are first and second grooves respectively extending around the first and second outer-perimeter walls; and wherein the first and second balls are spring biased at least partially into the respective first and second grooves, and the force along the press axis needed to slide the ball out of the groove while pushing back against the biasing of the spring is the releasably coupling of the adapters to the adapter-receiving apertures.

19. A ball joint press tool, comprising:

fame defining an adapter-receiving aperture having a first centroid and a press-assembly aperture having a second centroid, wherein the first and second centroids define a press axis, and the frame defining a spring-plunger aperture having an intersecting-end of the spring-plunger aperture intersecting a portion of the adapter-receiving aperture;

a spring-plunger at least partially disposed in the spring-plunger aperture, the spring-plunger having an adapter-engagement head at least partially disposed within the spring-plunger aperture and at least partially extendable into the adapter-receiving aperture;

a press assembly disposed in and extending, through the press-assembly aperture configured to actuate along the press axis toward and away from the adapter-receiving aperture;

an adapter having a connecting projection defining a spring-plunger engaging detent, the connecting projection at least partially disposable within the adapter-receiving aperture wherein the adapter-engagement head of the spring-plunger is engageable with the spring-plunger engaging detent;

wherein the adapter-receiving aperture defined by the frame is a first adapter-receiving aperture, and the press assembly further comprises an adapter-receiving segment defining a second adapter-receiving aperture;

wherein the adapter-receiving segment of the press assembly defines a second spring-plunger aperture, and the press assembly further comprises a second spring-plunger at least partially disposed in the second spring-plunger aperture, the second spring-plunger having a second adapter-engagement head at least partially disposed within the second spring-plunger aperture and at least partially extendable into the second adapter-receiving aperture; and wherein the second spring-plunger aperture is a number of second spring-plunger apertures, each having a second intersecting-end intersecting a portion of the second adapter-receiving aperture.

* * * * *